US006340221B1

(12) United States Patent
Driggers et al.

(10) Patent No.: US 6,340,221 B1
(45) Date of Patent: Jan. 22, 2002

(54) INK JET PRINT CARRIAGE DRIVE SYSTEM THAT APPLIES DRIVE FORCE AT LOCATION DISPLACED FROM DRIVE BELT

(75) Inventors: Matt G. Driggers; Robert P. Callaway, both of Vancouver, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/665,240

(22) Filed: Sep. 18, 2000

(51) Int. Cl.[7] ..... B41J 11/22
(52) U.S. Cl. ..... 347/37
(58) Field of Search ..... 347/37; 400/319, 400/320, 323, 334, 335, 352, 354, 357, 328

(56) References Cited

U.S. PATENT DOCUMENTS

| | | | | |
|---|---|---|---|---|
| 5,611,632 A | * | 3/1997 | Hiramatsu et al. | 400/335 |
| 5,964,542 A | | 10/1999 | Ruhe et al. | 400/352 |
| 5,966,147 A | * | 10/1999 | Matsui | 347/37 |
| 6,004,050 A | | 12/1999 | Rehman et al. | 400/319 |

* cited by examiner

*Primary Examiner*—Anh T. N. Vo
(74) *Attorney, Agent, or Firm*—Manuel Quioque

(57) ABSTRACT

A print carriage drive assembly for an ink jet printer. The print carriage drive assembly includes a tensioned drive belt, and a compliant belt connect that applies a driving force to a print carriage at location that is displaced from the drive belt. The tensioned drive belt and the belt connect further isolate the print carriage from drive force variations.

10 Claims, 4 Drawing Sheets

FIG. 5
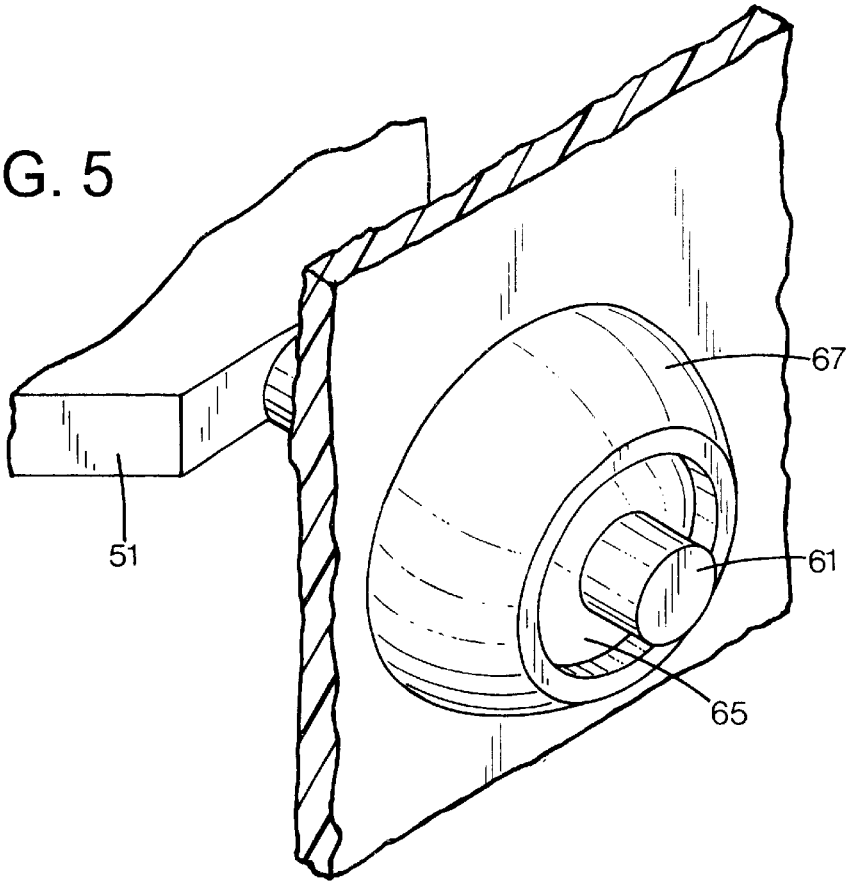
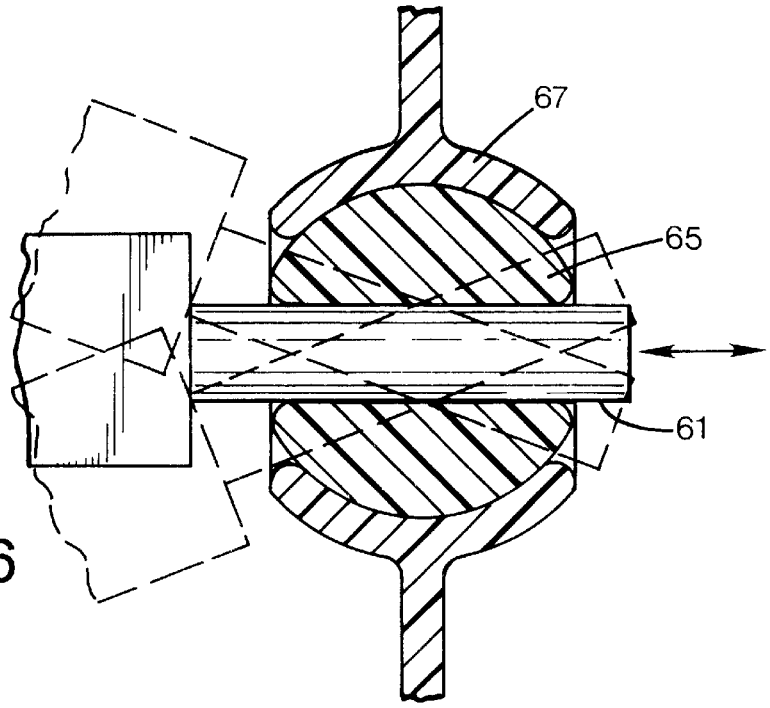
FIG. 6

INK JET PRINT CARRIAGE DRIVE SYSTEM THAT APPLIES DRIVE FORCE AT LOCATION DISPLACED FROM DRIVE BELT

BACKGROUND OF THE INVENTION

The disclosed invention relates to ink jet printing devices, and more particularly to improved techniques for driving a print carriage.

An ink jet printer forms a printed image by printing a pattern of individual dots at particular locations of an array defined for the printing medium. The locations are conveniently visualized as being small dots in a rectilinear array. The locations are sometimes called "dot locations," "dot positions," or "pixels". Thus, the printing operation can be viewed as the filling of a pattern of dot locations with dots of ink.

Ink jet printers print dots by ejecting very small drops of ink onto the print medium, and typically include a movable print carriage that supports one or more printheads each having ink ejecting nozzles. The print carriage is slidably supported by a slider rod and traverses back and forth over the surface of the print medium. While the print carriage moves back and forth, the nozzles are controlled to eject drops of ink at appropriate times pursuant to command of a microcomputer or other controller, wherein the timing of the application of the ink drops is intended to correspond to the pattern of pixels of the image being printed. Typically, a plurality of rows of pixels are printed in each traverse or scan of the print carriage. The particular ink ejection mechanism within the printhead may take on a variety of different forms known to those skilled in the art, such as those using thermal printhead or piezoelectric technology. For instance, two earlier thermal ink jet ejection mechanisms are shown in commonly assigned U.S. Pat. Nos. 5,278,584 and 4,683,481. In a thermal system, an ink barrier layer containing ink channels and ink vaporization chambers is disposed between a nozzle orifice plate and a thin film substrate. The thin film substrate typically includes arrays of heater elements such as thin film resistors which are selectively energized to heat ink within the vaporization chambers. Upon heating, an ink droplet is ejected from a nozzle associated with the energized heater element. By selectively energizing heater elements as the printhead moves across the print medium, ink drops are ejected onto the print medium in a pattern to form the desired image.

Typically, a print carriage is caused to move back and forth by a carriage motor that drives an endless belt attached to the carriage. A consideration with attaching a drive belt to a print carriage is the impartation of undesired twisting forces to the print carriage assembly, which detrimentally affect print quality. Another consideration is the difficulty and impracticality of attaching the belt at a location that is optimal for carriage dynamic stability, since other components are also mounted on the carriage and since the belt attachment apparatus tends to occupy a relatively large amount of space on the print carriage.

There is accordingly a need for an improved mechanism for driving a print carriage.

SUMMARY OF THE INVENTION

The disclosed invention is directed to a print carriage drive assembly that includes a print carriage that is slidably supported on a slider rod for reciprocating movement, a reciprocating belt configured to act like a spring, a belt clamp attached to the belt, and a compliant coupling structure connected between the belt attach and the print carriage for applying a driving force to the carriage at a location that is displaced from the belt and which can be selected to reduce moments that would otherwise be caused by application of the driving force. In accordance with a further aspect of the invention, the compliant coupling structure has rotational freedom of movement relative to the print carriage that allows small linear displacements along a carriage axis between the reciprocating belt and the print carriage, whereby the belt and the coupling structure cooperate to isolate the carriage from driving force variations.

BRIEF DESCRIPTION OF THE DRAWINGS

The advantages and features of the disclosed invention will readily be appreciated by persons skilled in the art from the following detailed description when read in conjunction with the drawing wherein:

FIG. 5 is a schematic view of another connector system of the carriage assembly of FIG. 2.

FIG. 6 schematically illustrates the freedom of angular movement of the connector system of FIG. 5.

DETAILED DESCRIPTION OF THE DISCLOSURE

Figure 1:
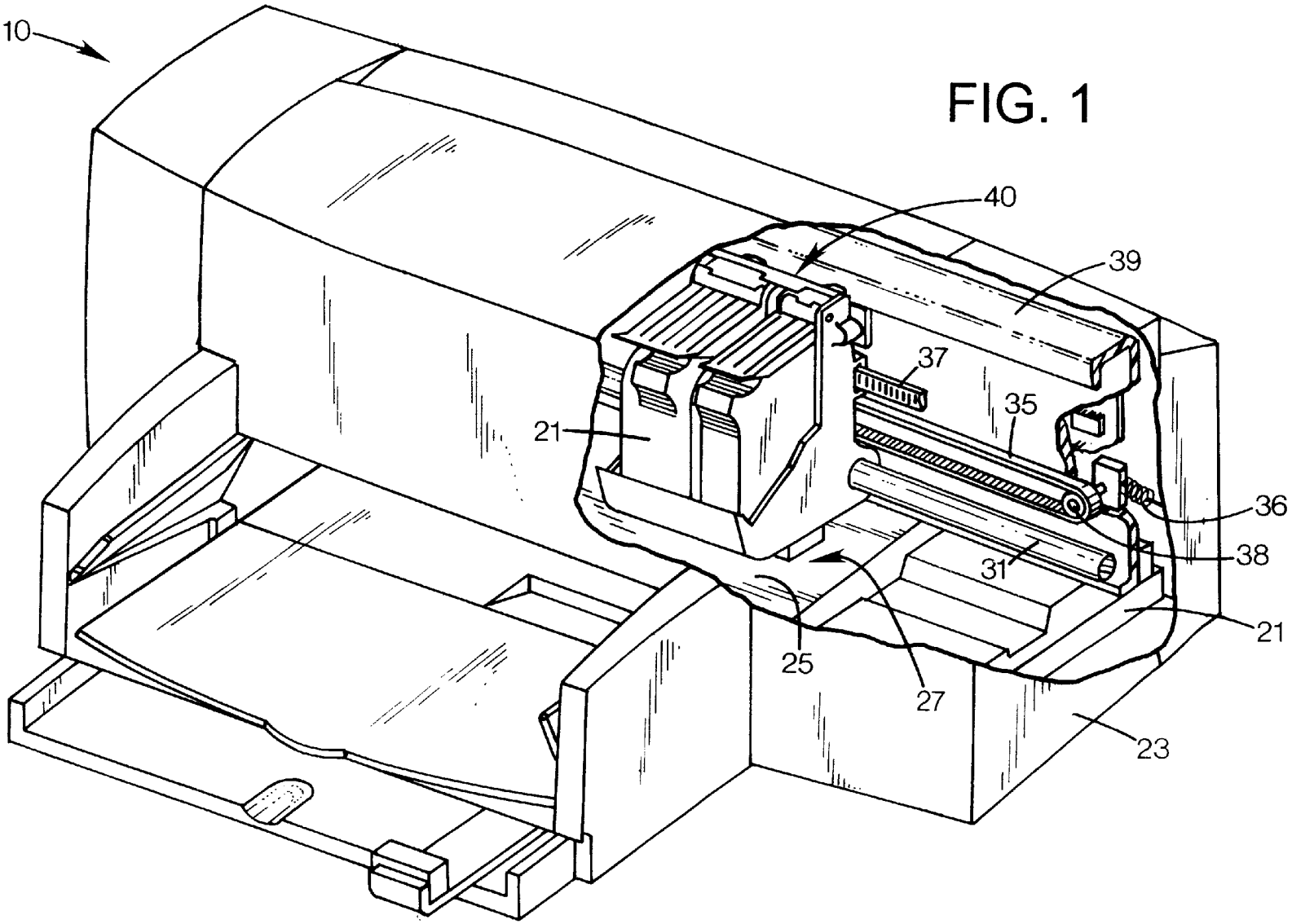
FIG. 1 is a schematic view of a printing mechanism that incorporates a carriage assembly in accordance with the invention

In the following detailed description and in the several figures of the drawing, like elements are identified with like reference numerals.

FIG. 1 sets forth a schematic perspective view of an example of an ink jet printing device 10 in which the disclosed invention can be employed. The ink jet printing device includes a reciprocating print carriage that is slidably mounted on a slider rod and supports one or more print cartridges having printing elements such as ink jet nozzles. In accordance with an aspect of the invention, the print carriage is moved by a compliant belt connect system 60 that applies a driving force to the print carriage at a location that is displaced from the belt and which can be selected so as to substantially reduce moments caused by the driving force. Further, the compliant belt connect system has rotational freedom of movement relative to the print carriage that allows small linear displacements between the print carriage and a tensioned drive belt, which isolates the print carriage from drive force variations.

The ink jet printing device 10 of FIG. 1 more particularly includes a frame or chassis 21 surrounded by a housing, casing or enclosure 23, commonly made of sheet metal and/or plastic. A sheet of print media 25 "picked" from a stack of sheets of print media is individually fed through a print zone 27 by a suitable media handling system. The print media may be any type of suitable sheet material such as paper, card-stock, transparencies, coated paper, fabric, and the like.

A carriage slider or guide rod 31 is supported by the chassis 21 to slidably support an ink jet print carriage 40 for back and forth, or reciprocating, motion across the print zone 27 along a carriage axis CA that is parallel to the longitudinal axis of the slider rod 31. A belt connect system 50 in accordance with the invention is connected between the print carriage 40 and a flexible drive belt 35 that is reciprocatingly driven by a carriage scan axis drive motor 33. The flexible drive belt 35 is configured to act like a spring, for example by being tensioned by a spring 36 that outwardly biases an idler pulley 38. Alternatively, the belt has an appropriate elasticity that allows the belt to act like a spring.

A linear encoder strip 37 is utilized to detect position of the print carriage 40 along the carriage scan axis, for example in accordance with conventional techniques.

The print carriage 40 supports, for example, a plurality of ink jet printhead cartridges 21, and in the print zone 27, the media sheet 25 receives ink from the ink jet printhead cartridges 21. Each of the ink jet printhead cartridges can comprise a single color printhead cartridge or a multiple color printhead cartridge. Also, each of the ink jet printhead cartridges 21 can comprise a self-contained printhead cartridge that includes one or more on-board ink reservoirs that are not coupled to remote ink reservoirs. Alternatively, each of the printhead cartridges can comprise a printhead cartridge having one or more small on-board ink reservoirs that are replenished from an "off-axis" ink supply that is separate from the printhead cartridge. By way of illustrative example, the print zone 27 is below the ink jet printhead cartridges 21, and the printheads thereof eject ink drops downwardly. Ink jet printhead cartridges 21 are also commonly called "pens" by those in the art.

It should be appreciated that the printing device of FIG. 1 can employ any number of printhead cartridges which for example can be thermal ink jet printhead cartridges.

Figure 2:
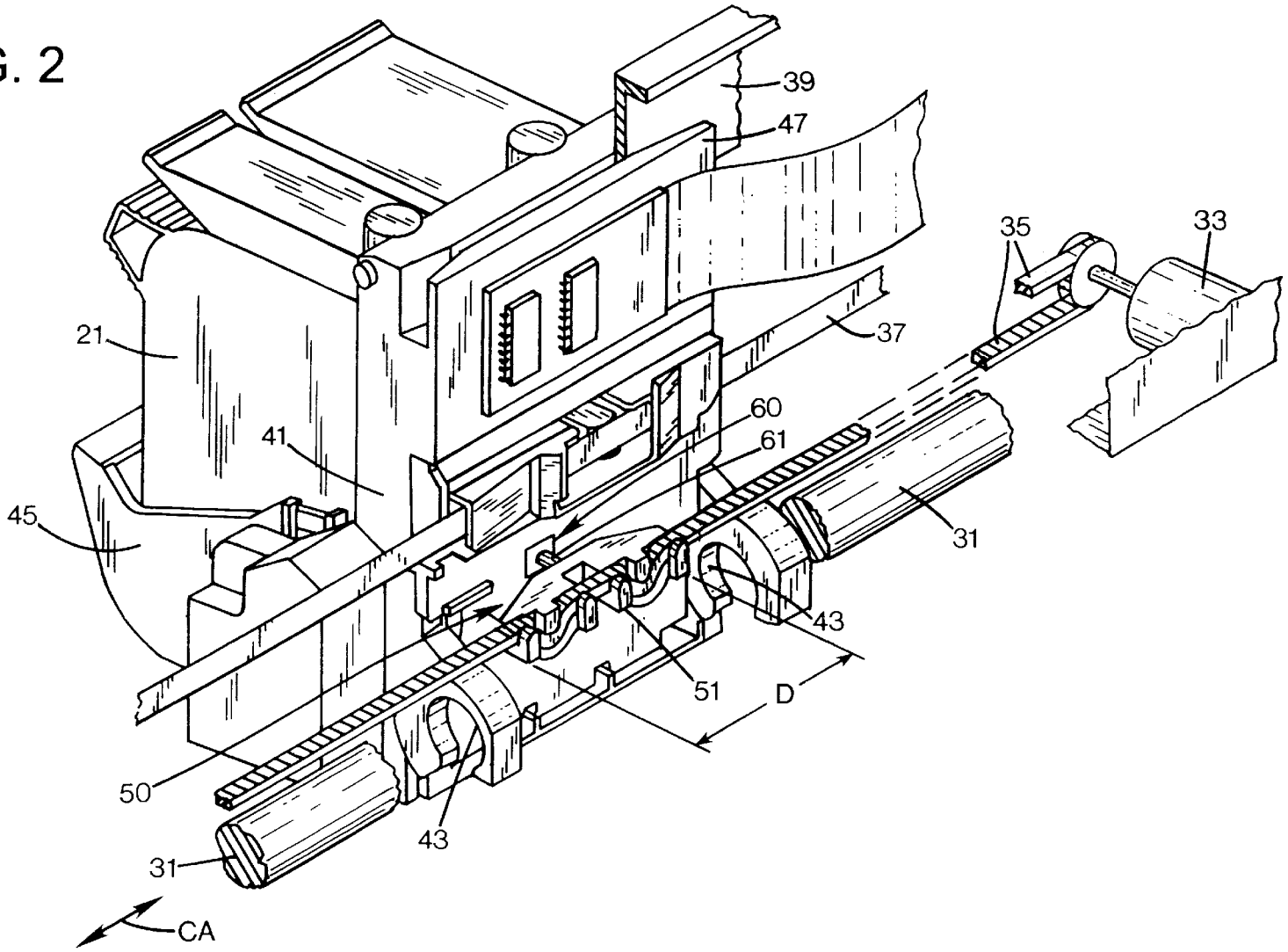
FIG. 2 is a schematic view of a carriage assembly in accordance with the invention.
Figure 3:
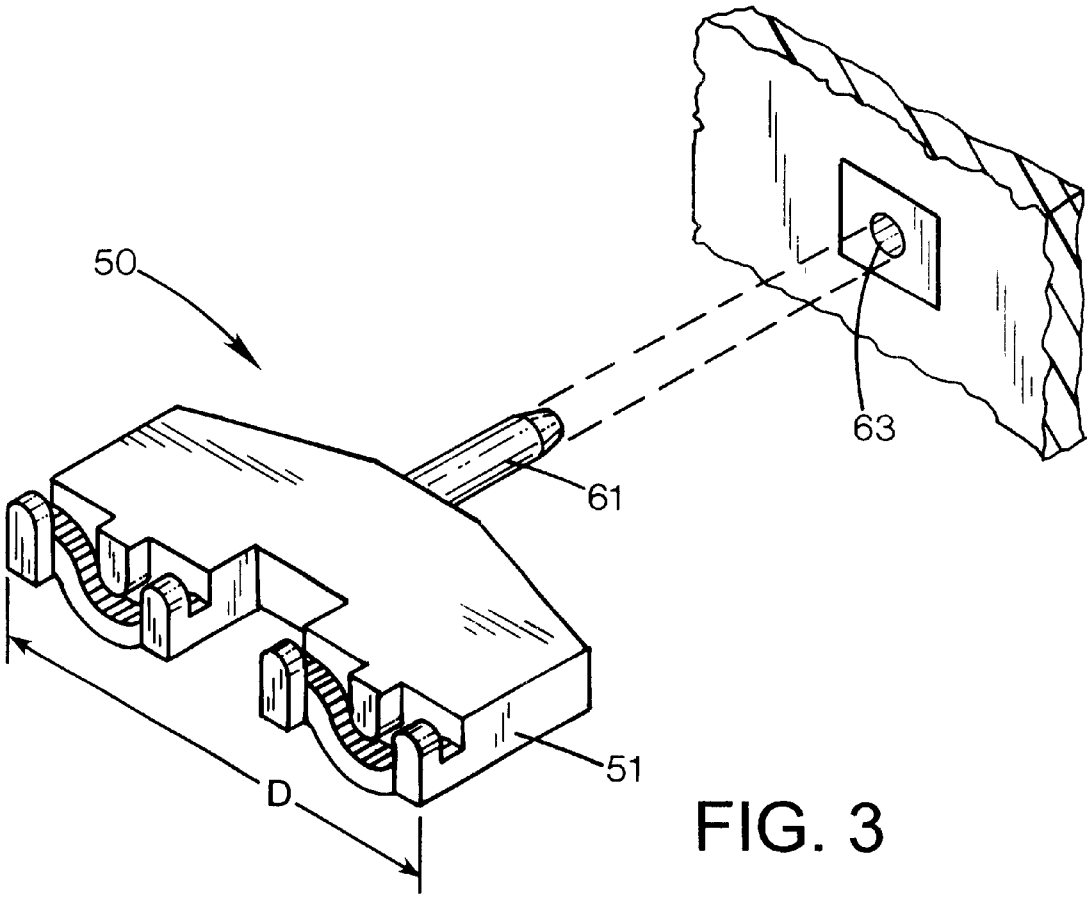
FIG. 3 is a schematic view of a connector system of the carriage assembly of FIG. 2.
Figure 4:
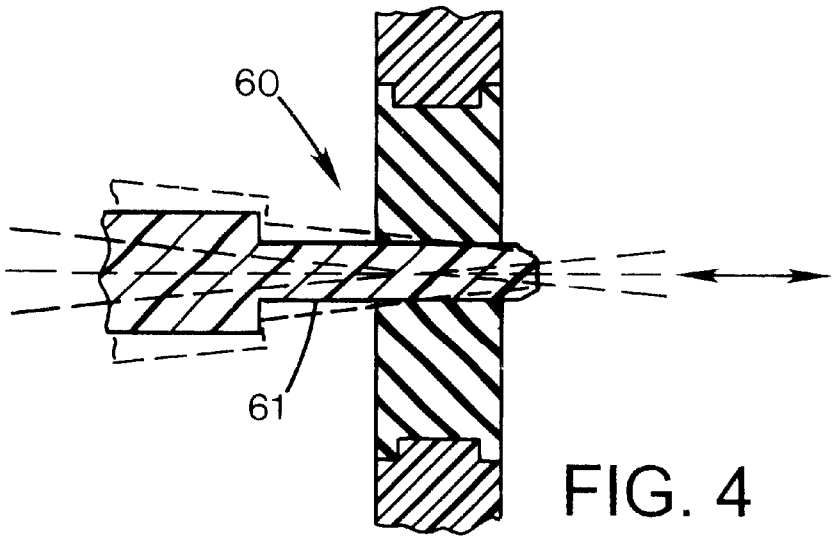
FIG. 4 schematically illustrates the freedom of angular movement of the connector system of FIG. 3.

Referring now to FIG. 2, the print carriage 40 more particularly includes a carriage chassis 41 that supports forwardly extending chutes or stalls 45 that support the printhead cartridges 21. Bearing supports 43 spaced apart along the carriage scan axis CA extend rearwardly from the carriage chassis 41 and slidably support the print carriage 40 on the slider rod 31 (FIG. 1). An anti-rotation feature 47 on the print carriage engages a surface of an anti-rotation rail 39 to prevent the print carriage 40 from rotating about the slider rod 31.

The belt connect system 50 that connects the belt to the print carriage 40 more particularly includes a belt clamp 51 that is attached to the belt 35 so as to effectively form an inflexible link in an endless belt, and a compliant connector structure 60 that provides for freedom of angular movement between the carriage 40 and the belt clamp 51 in a range of planes that are orthogonal to the carriage scan axis CA so as to allow small linear displacements between the belt and the carriage along the carriage axis CA.

For example, the compliant connector structure comprises a projecting peg or shank 61 that is fixedly attached to the belt clamp 51 and can be integrally formed therewith, and a compliant socket 63 disposed for example in a rear portion of the print carriage 40 for snugly receiving the connector shank 61 and allowing small linear displacements of the shank 61 along the axis thereof. The compliant socket 63 provides for a range of rotational freedom and comprises for example an elastomeric bushing that provides for a snug fit with the connector shank 61. The bushing can be formed for example of an aperture in an elastomeric block mounted in an opening of a rigid panel. Alternatively, the compliant socket can comprise a narrow slot having elastomeric inner edges.

The connector structure 60 can also comprise a ball and socket structure, as shown in FIGS. 5 and 6, wherein the peg 61 is slidably engaged in a ball 65 rotatably mounted in a socket 67 disposed in the print carriage 40.

The belt clamp 51 is more particularly attached to the belt at two attach points separated by a distance D, and thus functions as an inflexible link of length D in a continuous belt formed of the flexible belt 35 and the belt clamp 51. Accordingly, the belt clamp 51 has a lateral extent that spans the two locations at which it is attached to the belt, and the flexible belt 35 can be formed of a non-continuous belt having ends that are clasped by the belt clamp 51.

The foregoing connector system provides the belt clamp 51 with freedom of angular motion, including freedom of rotation in a plane defined by the belt attach points and the socket in the rear portion the print carriage 40, and with freedom of small linear movement along the axis of the shank. This allows small linear displacements along the carriage axis between the carriage and the belt to occur without impartation to the carriage of forces or moments except along the carriage axis, and in this manner the connector system 60 imparts to the carriage only forces along the carriage axis CA. In particular, as the motive force is applied to the print carriage 40 through the shank 61, the belt clamp 51 will tend to rotate such that the portions of the belt 35 at the lateral ends of the clamp 51 move out of alignment, which gives rise to a moment in the belt clamp 51 that counteracts the force applied to the shank 61. The undesired forces from the moment are thus taken up by the deflection of the belt 35 rather than being transmitted to the carriage 40, and the shank 61 thus imparts only a linear force and only along the carriage scan axis CA, and does not impart moments to the print carriage 40. Effectively, the connector structure 60 allows for compliant angular movement or pivoting of the belt clamp 51, such that the clamp 51 can be deflected to move the ends thereof out of alignment with the belt 35 and such that the carriage can be slightly displaced relative to the belt along the carriage axis.

Insofar as the driving force is applied to the carriage at an interface between the shank and the compliant socket, the connector system provides for application of a linear driving force along the carriage axis at a location that is selectably displaced from the belt and the belt clamp. Preferably, the connector structure 60 is configured such that the interface between the peg and the print carriage 40 (i.e., where the driving force is applied to the print carriage) is optimally located, for example close to a centroid of the retarding forces to which the carriage 40 is subjected (e.g., mass and friction), depending upon a balance between performance objectives and constraints of part size and placement. By way of specific example, the compliant socket 63 is offset slightly from the center of mass to balance the moments induced by the drag forces of the bearing supports 43 and the anti-rotation feature 47. This is readily and efficiently achieved since the connector structure 60 can be quite small in size.

The rotational freedom of movement of the connector system and spring like action of the drive belt further provide mechanical filtering without the extra parts that would otherwise be needed to provide comparable mechanical filtering. In particular, since the belt tension of the mis-aligned belt portions produce more moment as the rotation of the belt clamp 51 increases, the belt 35 acts similarly to a spring. Since the connector system only contacts the drive belt and the carriage, the spring-like action of the belt mechanically filters higher frequency driving force variations from the print carriage 40 and thus isolates the carriage from driving force variations. The belt and connector system of the invention also prevent drive force vibrations from being transmitted to structures supporting the print carriage including the slider rod.

The length D between the attach points of the belt clamp is chosen in conjunction with the tension forces of the belt 35 and the motive force reaction to only allow angular movement that is suitable for the requirements of the particular printer. For example, a long length D may not reasonably fit with the size desired for the printer, while a short length D may allow excessive angular movement such that the belt clamp would interfere with other mechanical components as the carriage 40 moves along the guide rod 31.

The amount of angular movement of the belt clamp is determined by the balance of the forces provided by the tension forces of the belt 35 at the two attach points of the belt clamp 51 and the motive force reaction experienced by the peg 61 at the socket in the rear of the print carriage.

The foregoing has been a disclosure of a print carriage drive system that advantageously applies to the print carriage a linear driving force at a location that is selectably displaced from the belt attach and can be placed at or close to an optimal location. The print carriage drive system further advantageously isolates the print carriage from driving force variations.

Although the foregoing has been a description and illustration of specific embodiments of the invention, various modifications and changes thereto can be made by persons skilled in the art without departing from the scope and spirit of the invention as defined by the following claims.

What is claimed is:

1. A print carriage assembly for a printer comprising:

a print carriage slidably mounted on a slider rod that is parallel to a carriage scan axis;

a reciprocating drive belt;

a belt clamp attached to said drive belt;

a compliant coupling structure comprising a shank and a socket interposed between said belt clamp and said print carriage for applying a driving force to said print carriage at a location that is displaced from said belt clamp, said compliant coupling structure configured to deflect said belt while applying said driving force to said print carriage.

2. A print carriage assembly for a printer comprising:

a print carriage slidably mounted on a slider rod that is parallel to a carriage scan axis;

a reciprocating drive belt;

a belt clamp attached to said drive belt;

a compliant coupling structure comprising a ball and a socket structure interposed between said belt clamp and said print carriage for applying a driving force to said print carriage at a location that is displaced from said belt clamp, said compliant coupling structure configured to deflect said belt while applying said driving force to said print carriage.

3. A print carriage assembly for a printer comprising:

a print carriage slidably mounted on a slider rod that is parallel to a carriage scan axis;

a reciprocating drive belt;

a belt clamp attached to said drive belt;

a compliant coupling structure interposed between said belt clamp and said print carriage for applying a driving force to said print carriage at a location that is displaced from said belt clamp and located close to a centroid of retarding forces to which said carriage is subjected, said compliant coupling structure configured to deflect said belt while applying said driving force to said print carriage.

4. The print carriage assembly of claim 3 wherein said compliant coupling structure comprises a shank and a socket.

5. The print carriage assembly of claim 3 wherein said compliant coupling structure comprises a ball and socket structure.

6. A printing system comprising:

a print carriage slidably mounted on a slider rod;

an image forming element supported by said print carriage;

a reciprocating drive belt;

a belt clamp attached to said drive belt; and a compliant coupling structure comprising a shank and a socket interposed between said belt clamp and said print carriage for applying a driving force to said print carriage at a location that is displaced from said belt clamp, said compliant coupling structure configured to deflect said belt while applying said driving force to said print carriage.

7. A printing system comprising:

a print carriage slidably mounted on a slider rod;

an image forming element supported by said print carriage; and a reciprocating drive belt;

a belt clamp attached to said drive belt;

a compliant coupling structure comprising a ball and a socket structure interposed between said belt clamp and said print carriage for applying a driving force to said print carriage at a location that is displaced from said belt clamp, said compliant coupling structure configured to deflect said belt while applying said driving force to said print carriage.

8. A printing system comprising:

a print carriage slidably mounted on a slider rod;

an image forming element supported by said print carriage; and a reciprocating drive belt;

a belt clamp attached to said drive belt;

a compliant coupling structure interposed between said belt clamp and said print carriage for applying a driving force to said print carriage at a location that is displaced from said belt clamp and located close to a centroid of retarding forces to which said carriage is subjected, said compliant coupling structure configured to deflect said belt while applying said driving force to said print carriage.

9. The print carriage assembly of claim 8 wherein said compliant coupling structure comprises a shank and a socket.

10. The print carriage assembly of claim 8 wherein said compliant coupling structure comprises a ball and socket structure.

* * * * *